US007975452B2

(12) United States Patent
Wennberg

(10) Patent No.: US 7,975,452 B2
(45) Date of Patent: Jul. 12, 2011

(54) BUILDING STRUCTURED MATERIAL USING CELL GEOMETRY

(75) Inventor: Paul Wennberg, Redmond, WA (US)

(73) Assignee: B. Braun Medizinelektronik GmbH & Co. KG, Puchheim (DE)

( * ) Notice: Subject to any disclaimer, the term of this patent is extended or adjusted under 35 U.S.C. 154(b) by 800 days.

(21) Appl. No.: 11/933,949

(22) Filed: Nov. 1, 2007

(65) Prior Publication Data

US 2008/0276548 A1 Nov. 13, 2008

Related U.S. Application Data

(60) Provisional application No. 60/916,927, filed on May 9, 2007.

(51) Int. Cl.
*E04B 2/08* (2006.01)

(52) U.S. Cl. ..... 52/589.1; 52/79.1; 52/79.2

(58) Field of Classification Search ..... 52/589.1, 52/79.2, 79.3, 79.6, 79.13, 79.9; 108/53.5, 108/91, 190; 312/107, 108
See application file for complete search history.

(56) References Cited

U.S. PATENT DOCUMENTS 1,234,628 A * 7/1917 Christensen ..... 108/91
1,355,486 A * 10/1920 Longenecker ..... 211/126.2
3,053,558 A * 9/1962 Challas, Jr. et al. ..... 108/53.5
3,390,589 A * 7/1968 Tschanz ..... 74/502.4
3,695,190 A * 10/1972 Bucholz ..... 108/91
3,928,950 A 12/1975 Beynon
4,129,969 A * 12/1978 Haapala ..... 52/79.9
4,145,977 A * 3/1979 Yellin ..... 108/190
4,681,477 A * 7/1987 Fischer ..... 403/298
4,757,769 A * 7/1988 Suttles ..... 108/190
6,520,095 B1 * 2/2003 Hayes ..... 108/190

FOREIGN PATENT DOCUMENTS

JP 10121778 5/1998
JP 11301738 11/1999
JP 2002339592 11/2002

* cited by examiner

*Primary Examiner* — Basil Katcheves
(74) *Attorney, Agent, or Firm* — Black Lowe & Graham, PLLC

(57) ABSTRACT

A cellular building block including a middle beam and two legs. The cellular building block having the first leg coupled to the middle beam such that the leg is perpendicular to the middle beam and a second leg coupled to the middle beam such that the leg is perpendicular to the middle beam and spaced apart from the first leg, the first leg and the second leg having an inside edge and an outside edge. Having at least one barb located on the inside edge of the first leg and on the inside edge of the second leg and further configured to lock into a recess. The cellular building blocks connect in a two dimensional or three dimensional pattern and a produce a structured material that holds itself together and exhibits beneficial characteristics.

15 Claims, 14 Drawing Sheets

BUILDING STRUCTURED MATERIAL USING CELL GEOMETRY

PRIORITY CLAIM

This application claims the benefit of U.S. Provisional Application Ser. No. 60/916,927 filed on May 9, 2007, which is herein incorporated by reference in its entirety.

FIELD OF THE INVENTION

This invention related generally to structured building materials and, more specifically, to cellular building blocks configured to connect in a multi-dimensional pattern to produce an improved structured building material exhibiting beneficial characteristics.

BACKGROUND OF THE INVENTION

Wood is a preferred material for building structures because it has high strength, low density and it may be sawed, cut and/or have a nail driven into it. However, in some areas, there is a limited supply of wood to use as a building material. There currently exists a need for a replacement for wood that does not contain wood, glue, plastic or hydrocarbons in general. The replacement would have similar characteristics of wood. Finally, it could be manufactured using local materials, without trees and with minimal expense.

SUMMARY OF THE INVENTION

A cellular building block including a middle beam and two legs. The cellular building block having the first leg coupled to the middle beam such that the leg is perpendicular to the middle beam and a second leg coupled to the middle beam such that the leg is perpendicular to the middle beam and spaced apart from the first leg, the first leg and the second leg having an inside edge and an outside edge. Having at least one barb located on the inside edge of the first leg and on the inside edge of the second leg and further configured to lock into a recess.

A method for using a cellular building block including aligning a guide portion of each leg from a first block with guide portions of a leg from a second block and a third block. Applying pressure sufficient to urge the barb, coupled to legs of the first block, into recesses defined by the leg in the second and third block; and locking the blocks together by confirming that all of the barbs of the first block are in the recesses of the second and third block and the barbs of the second and third block are in the recesses of the first block. A continuation of this process will produce a material where cells hold each other together.

BRIEF DESCRIPTION OF THE DRAWINGS

The preferred and alternative embodiments of the present invention are described in detail below with reference to the following drawings.

FIG. 10A-10B shows cells connected in three dimensions in one embodiment;

DETAILED DESCRIPTION OF THE PREFERRED EMBODIMENT

In one embodiment a cell uses a variety of different types of materials made separately into cells and connected mechanically using different geometries. These geometries include, but are not limited to, rectangular and prismatic geometries, which provide cohesion and strength based on the geometry of the composition. The different geometries combine materials at a cellular level to produce advantageous characteristics in the resulting composition. The advantageous properties include, but are not limited to, low density, strength, toughness, and/or fire resistance.

Figure 1:
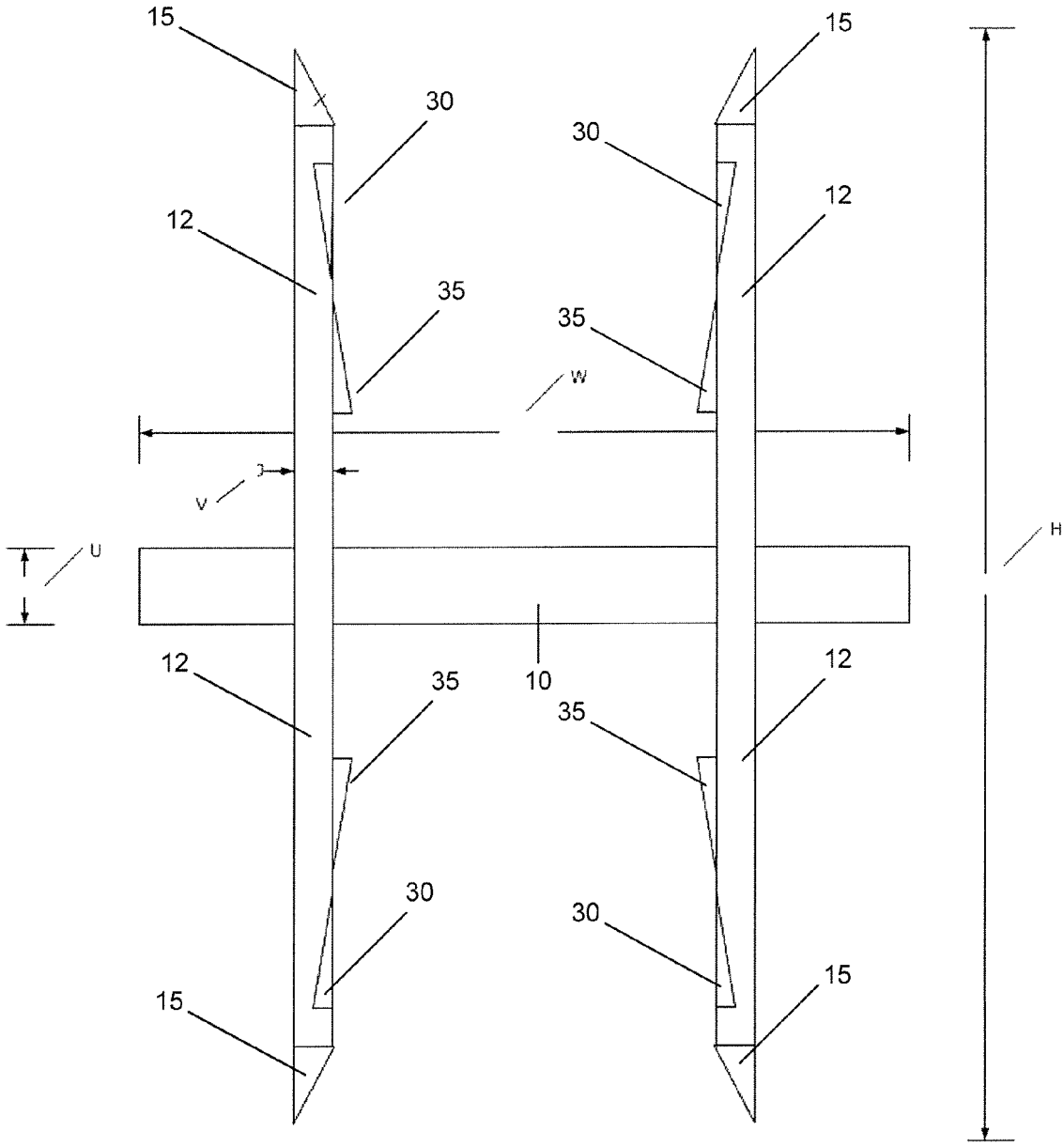
FIG. 1 shows a two-dimensional top view of one embodiment.

FIG. 1 shows a two-dimensional top view of one embodiment. The cell has a middle beam 10. The middle beam has a width, a length and a depth. The cell has two legs 12, each leg connected along the width (X axis) of the middle beam. Each leg has a length and a width. At each end of the legs is a guide 15. The guide allows for easy connection with another cell. The leg has a barb 35 located on the inside of the leg. The barb is configured to securely lock in the recess 30. The cell is composed of, but not limited to, at least one of ceramics, metals, concrete, stone, clay and plastic. These cells are made with a machine or manually by a human in the manual process. In one embodiment the cells range from 1 mm to 10 cm.

FIG. 1 further shows the important dimensions of a cell. The width of the cell W is measured along the cells X axis. The height of the cell H is measured along the cell's Y axis. The gap between cell middle beam intersections is represented by D. The width of each leg is represented by V. The depth of the middle beam, M, is measured along the cell's z axis. Finally, U is the width of the middle beam and is measured along its Y axis.

The following dimensions are derived in one embodiment. The depth of each barb A is derived from the width of each leg V divided by four. The length of each barb B is derived from the depth of the barb multiplied by eight. The distance between the legs P is derived from the basic width of the cell divided by two. The distance between the center lines of the legs Q is derived from the distance between the legs P added to the width of a leg V. The distance between outside lines of the legs R is derived from the distance between the center lines of the legs Q added to the width of the leg V. The length of a leg G is derived from the width of the middle beam U subtracted from the height of the cell H and then divided by two. The resulting number is then multiplied by 0.95 to find the length of the leg. The length of the middle beam S is derived from the gap between adjacent cell middle beams D subtracted from the basic width of the cell W. The distance from the outside of the leg to the middle beam intersection N is derived from the distance between the outside lines of the legs R subtracted from the basic width of the cell W and then divided by two.

In one embodiment, it is preferred, but not necessary, to have the following relationships. The depth of each barb is less than or equal to the width of each leg divided by two. The length of each barb is greater than two times the depth of the barb. The depth of the barb is two times the gap between adjacent cell middle beam intersections. The length of a leg is less than the width of the middle beam subtracted from the basic height of the cell and then divided by two. In a three-dimensional cell, the depth of the middle beam is less than the distance from the outside of the leg to the middle beam intersection. Further the depth of the barb is also constrained by the elasticity of the material and the length of the leg in one embodiment. As a cell is coupled to another, the legs will bend slightly to overcome the depth of the barb until the barb reaches the recess.

In an alternate embodiment the barbs are removed from one end and recesses are removed from the other end resulting in a cell that is polarized. The cell would have a positive and negative side, and as long as the cells were organized with the correct polarization would form a lattice. In yet another alternate embodiment the cells may be connected without barbs or recesses using rivets, pins and/or screws.

Figure 2:
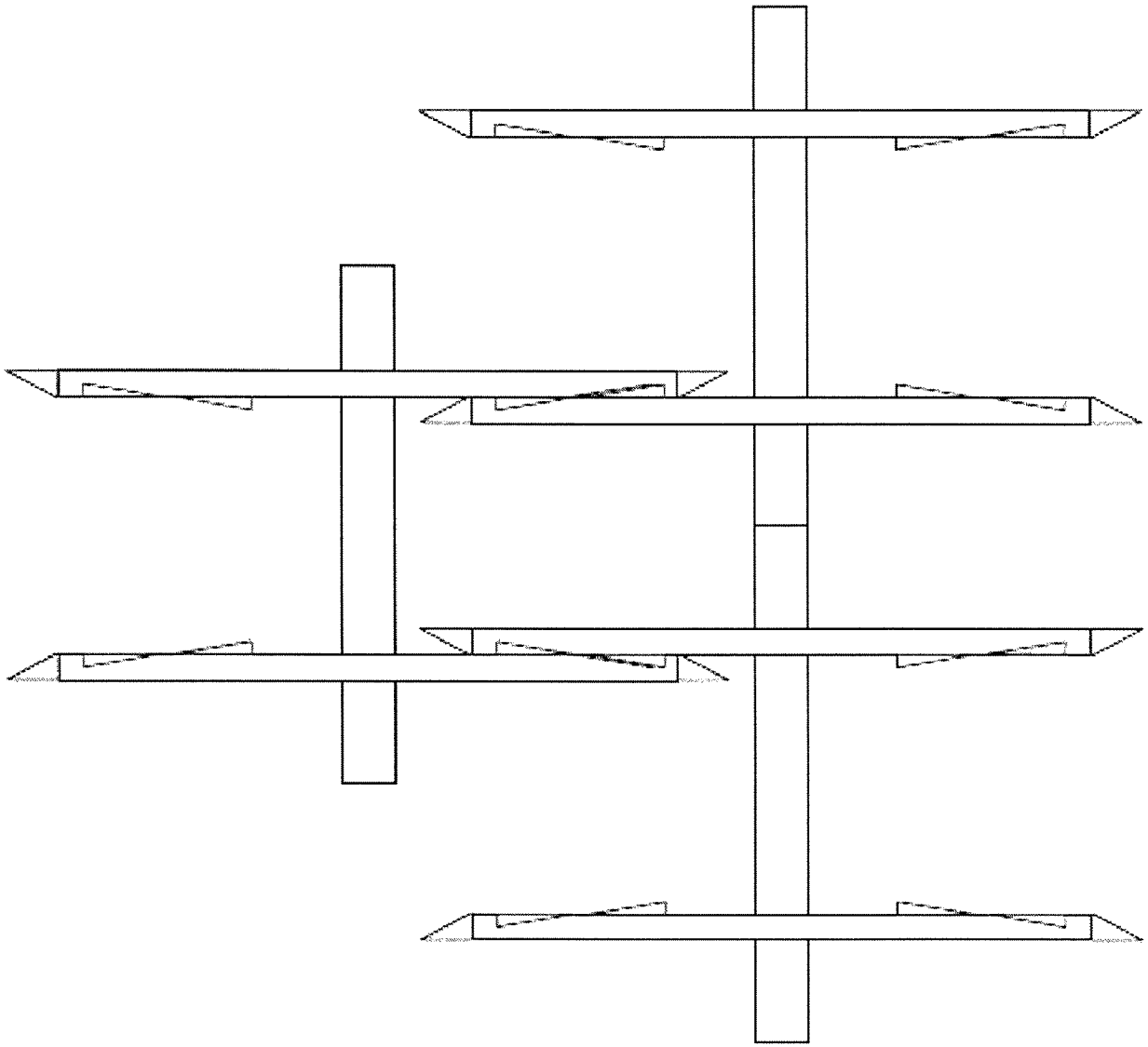
FIG. 2 is a top view showing the basic connection of three cells in a two-dimensional arrangement.

FIG. 2 is a top view showing the basic connection of three cells in a two-dimensional arrangement. As shown two-dimensional cells are connected together to form an array. The cells in two dimensions are designed such that if the two-dimensional array is subject to bending forces then the bending is distributed among all cell structures. Further damage or a crack to one cell will not propagate to others.

Figure 3A:
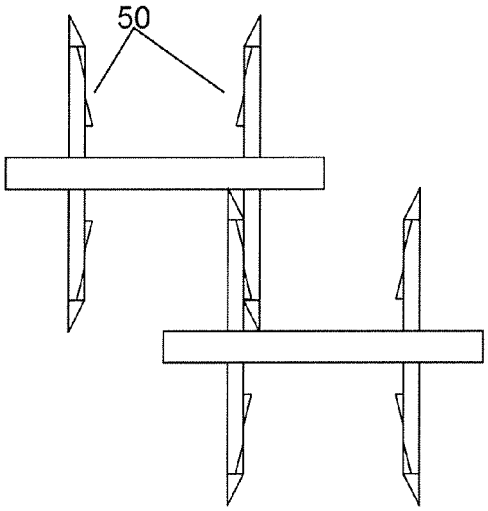
FIGS. 3A-3D show multiple connection methods of cells in a two-dimensional arrangement.
Figure 3B:
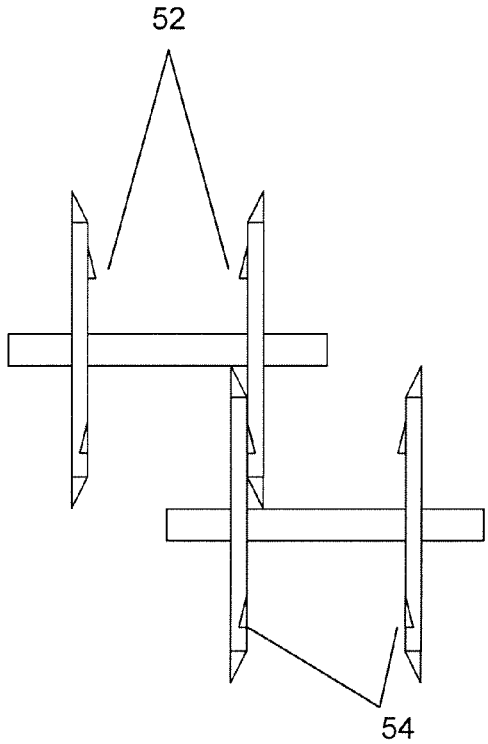
Figure 3C:
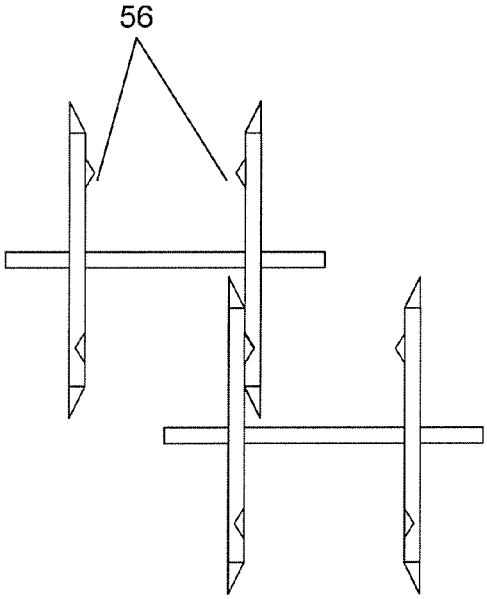
Figure 3D:
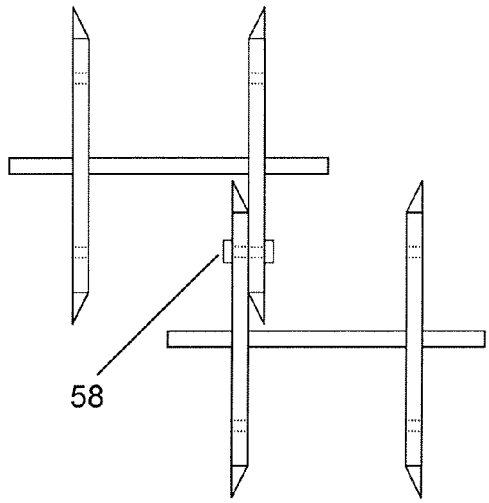
Figure 4A:
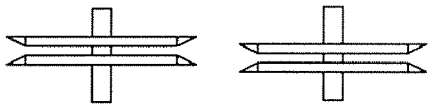
FIGS. 4A-4E show multiple embodiments of cell end pieces.
Figure 4B:
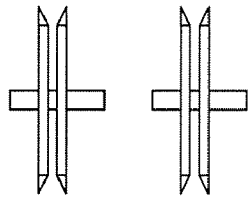
Figure 4C:
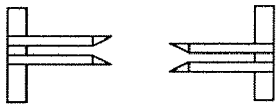
Figure 4D:
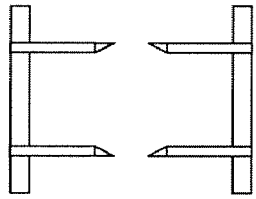
Figure 4E:
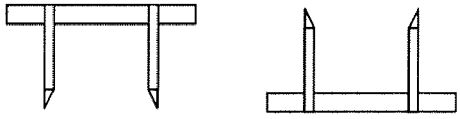

FIGS. 3A-3D show multiple connection methods of cells in a two-dimensional arrangement. FIG. 3A shows a cell with bidirectional barbs 50, also shown in FIG. 1. The barbs shown are symmetrical. FIG. 3B shows a cell with polarized barbs. One side as protruding barbs 52, wherein the other side has a matching indent 54. The cells in this arrangement connect in one direction. FIG. 3C shows a cell with a polarized and removable connection 56. If the cell is connected horizontally and in this configuration the cell would have a spring constant dependent on the shape and depth of the protrusions and indents. FIG. 3D shows cells preferably connected by a fastener 58, such as screw, rivet, or push pin through a hole.

FIGS. 4A-4E show multiple embodiments of cell end pieces. In one embodiment cells may be modified to be end pieces. As a result a block of cells will preferably have a smoother surface.

Figure 5A:
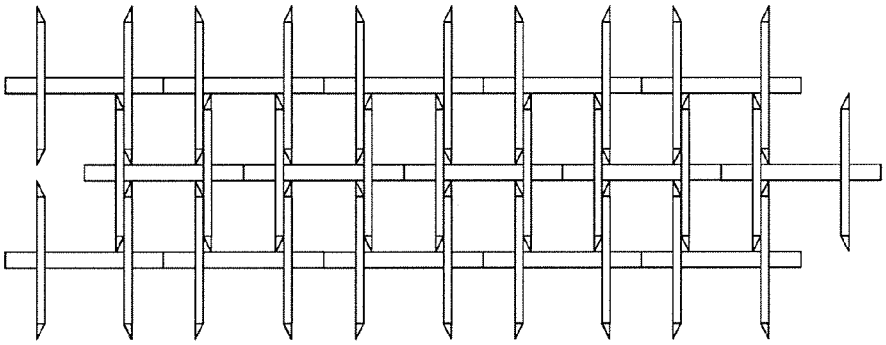
FIGS. 5A-5B show cells connected vertically and horizontally in one embodiment.
Figure 5B:
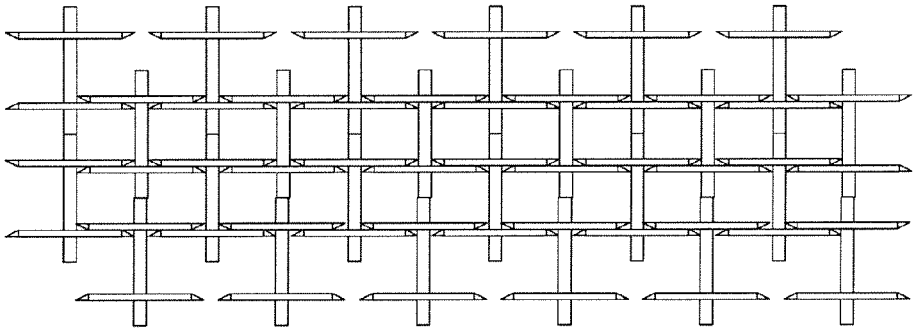

FIGS. 5A-5B show cells connected vertically and horizontally in one embodiment. FIG. 5A shows cells connected vertically. When connected vertically compression and tension forces are evenly distributed. In this case there is a low shear stress put on the vertical cell leg connections. FIG. 5B shows cells connected horizontally. In this case more shear stress is put on the cell leg connections; however, there are many advantages to this arrangement.

Figure 6A:
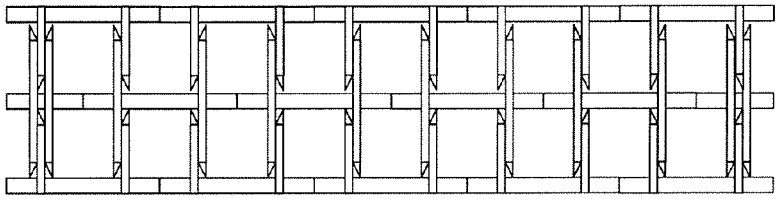
FIGS. 6A-6B show cells connected vertically and horizontally with end pieces attached in one embodiment.
Figure 6B:
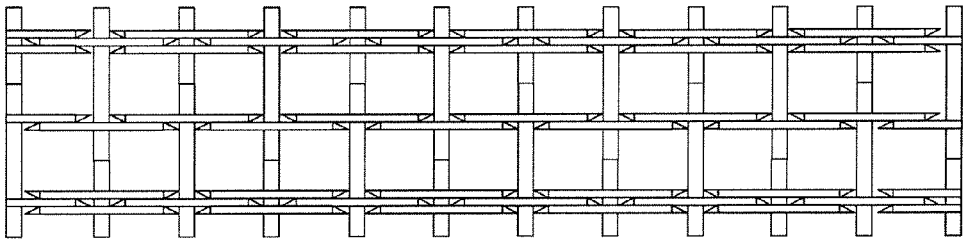

FIGS. 6A-6B show cells connected vertically and horizontally with end pieces attached in one embodiment. FIG. 6A shows cells connected vertically with end pieces attached to provide a generally smooth surface. FIG. 6B shows cells connected horizontally with end pieces attached to provide a generally smooth surface.

Figure 7:
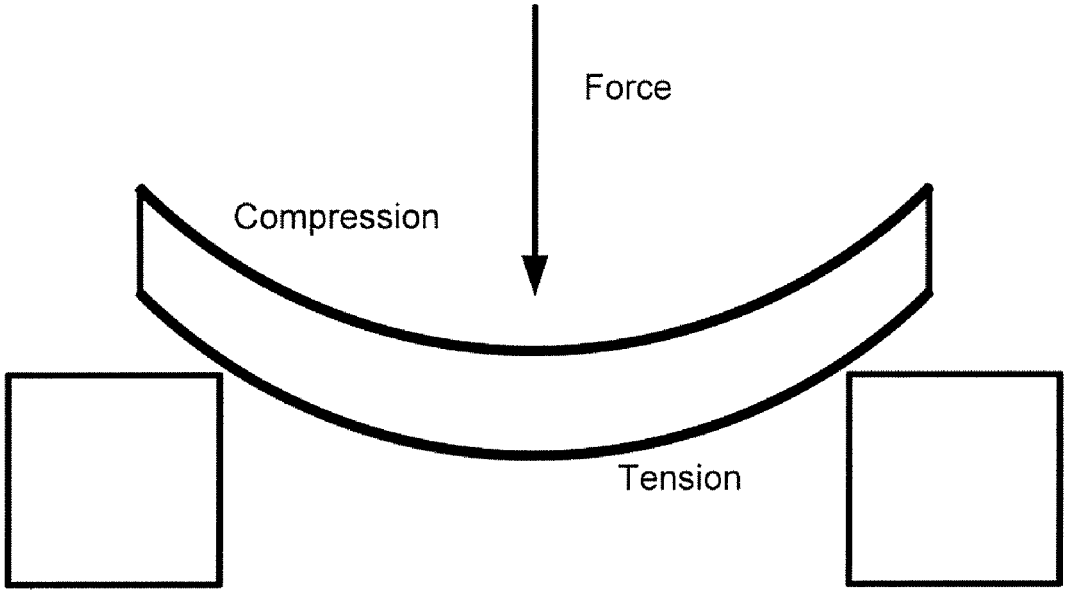
FIG. 7 shows a sample of the force applied to a series of connected cells.

FIG. 7 shows a sample of the force applied to a series of connected cells. In one embodiment compression and tension forces are distributed evenly when force is applied.

Figure 8A:
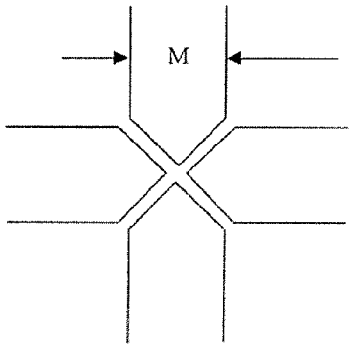
FIGS. 8A-8C shows the middle beam intersection of four three dimensional cells.
Figure 8B:
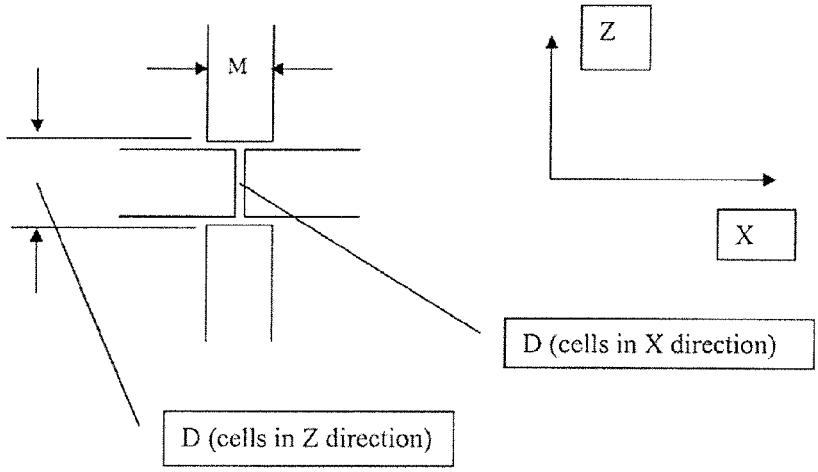
Figure 8C:
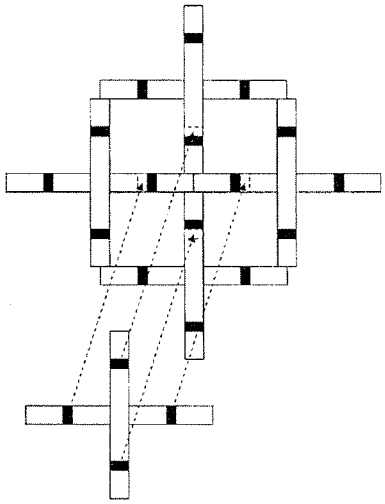

FIGS. 8A-8C shows the middle beam intersection of four three dimensional cells in a lattice. The gap between the middle beam intersections D is represented both along the X and the Z axis. The depth of the middle beam is represented by M. FIG. 8C shows a top view of four three dimensional cells, the legs are grey in this top view.

Figure 9A:
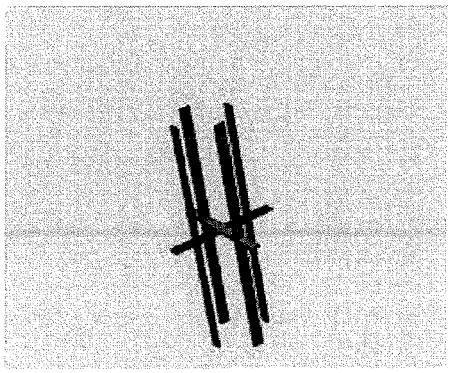
FIGS. 9A-9C shows two two-dimensional cells in a three-dimensional arrangement.
Figure 9B:
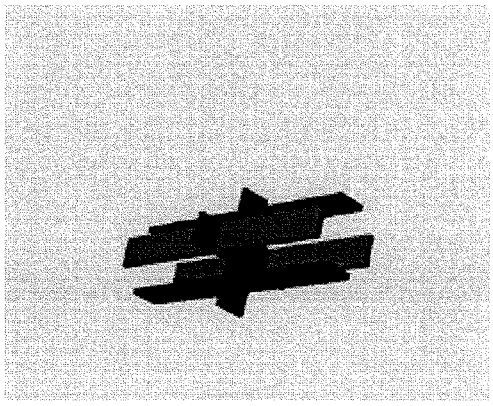
Figure 9C:
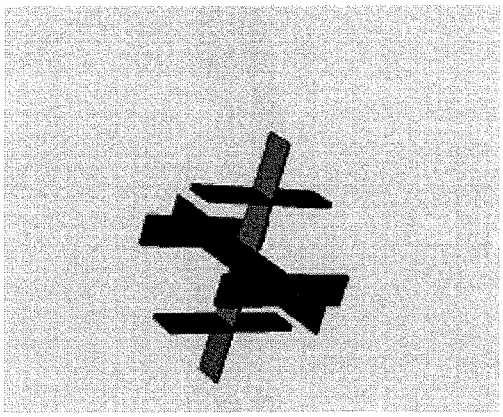

FIGS. 9A-9C show two cells in a three-dimensional arrangement. The three-dimensional cells consist of two two-dimensional cells connected together at ninety degrees in the center of the middle beam. In a preferred embodiment a large number of three-dimensional cells would form a lattice. The lattice when subjected to bending forces distributes the bending forces across all cells. In a small celled three-dimensional lattice, in one example, a nail is driven into the material, and while it may break a cell initially, the cell lattice will provide resistance in a distributed fashion on the nail.

Figure 10A:
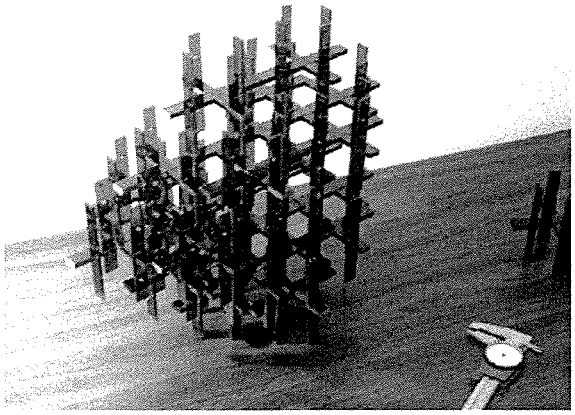
Figure 10A:
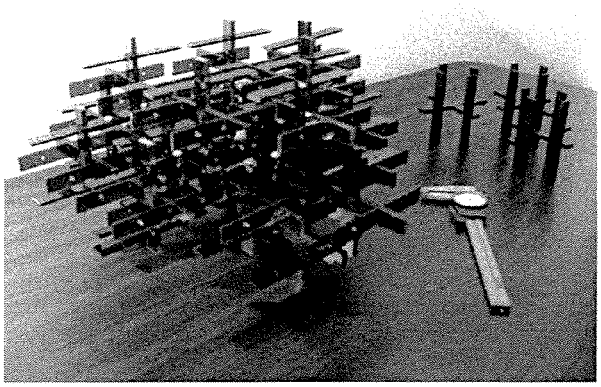

FIGS. 10A-10B show example cell connections in three dimensions in one embodiment. FIG. 10A shows an example of cells connected vertically. FIG. 10B shows an example of cells connected horizontally.

Figure 11:
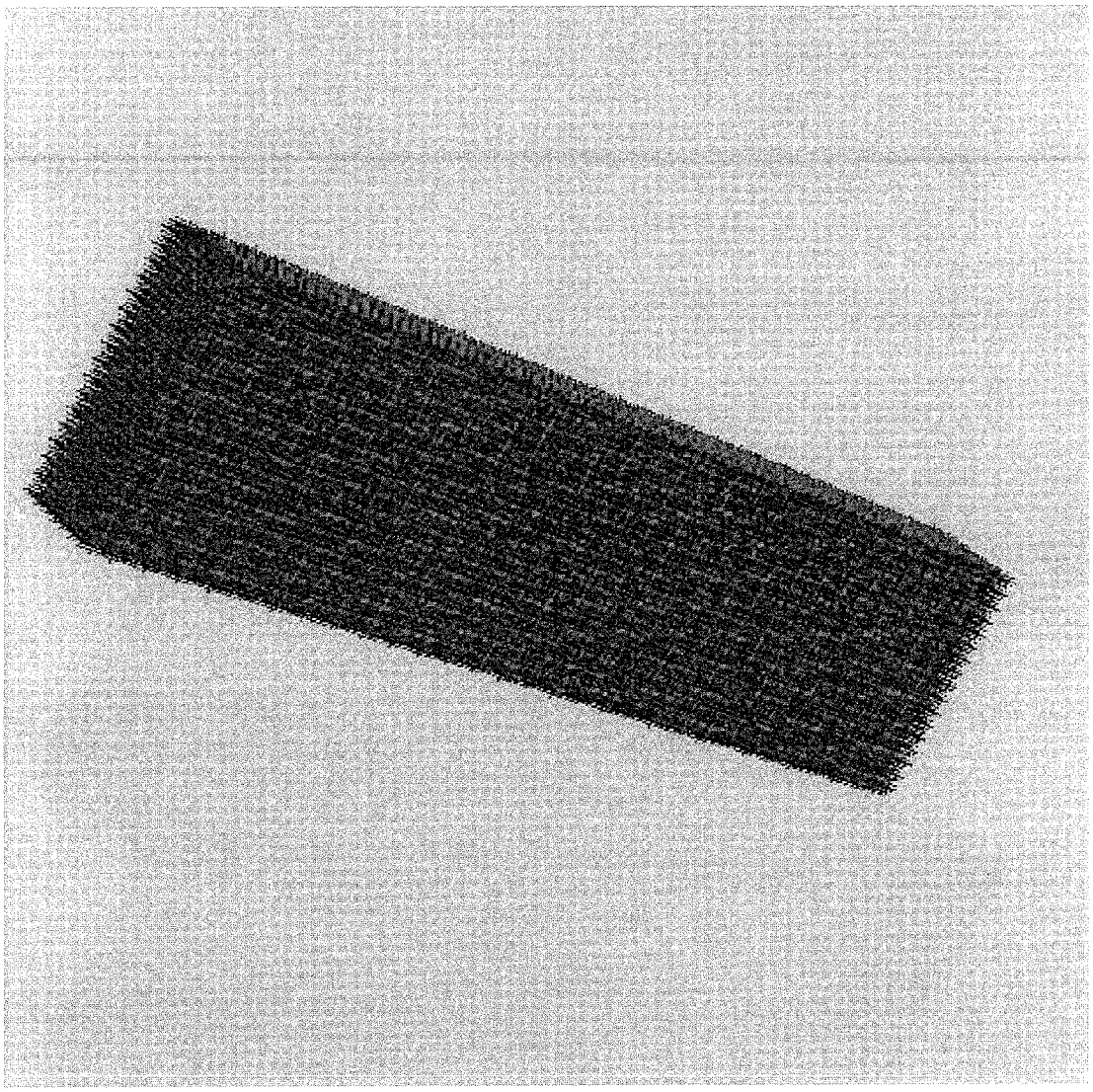
FIG. 11 shows a model 2×4 board with cells designed to present a flat surface.
Figure 12:
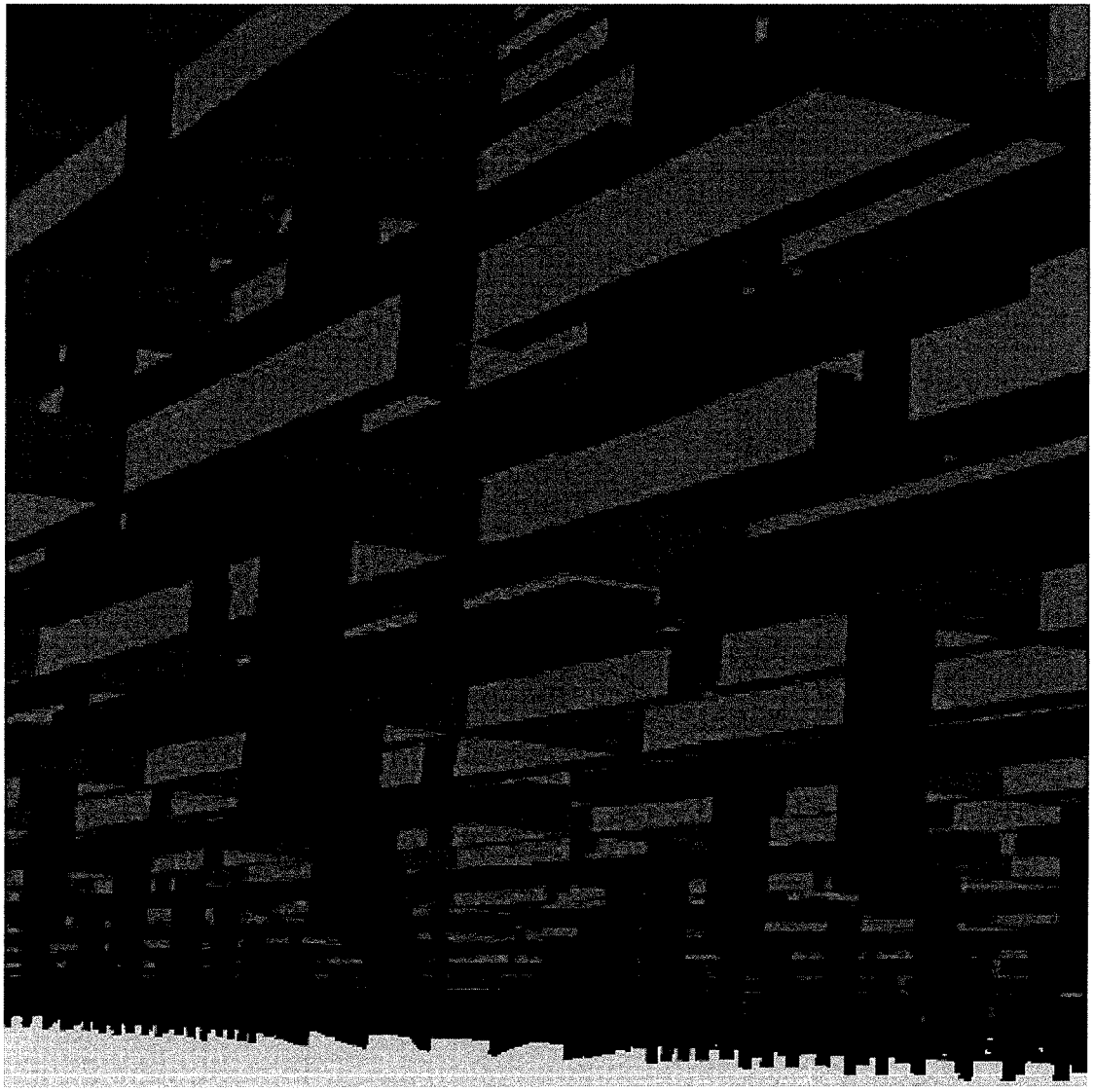
FIG. 12 shows a close-up view of the surface of FIG. 11.

FIG. 11 shows a model 2×4 board with cells designed to present a flat surface. The 2×4 is made up of a lattice of three-dimensional cells. FIG. 12 shows a close up view of the surface of FIG. 11.

Figure 13:
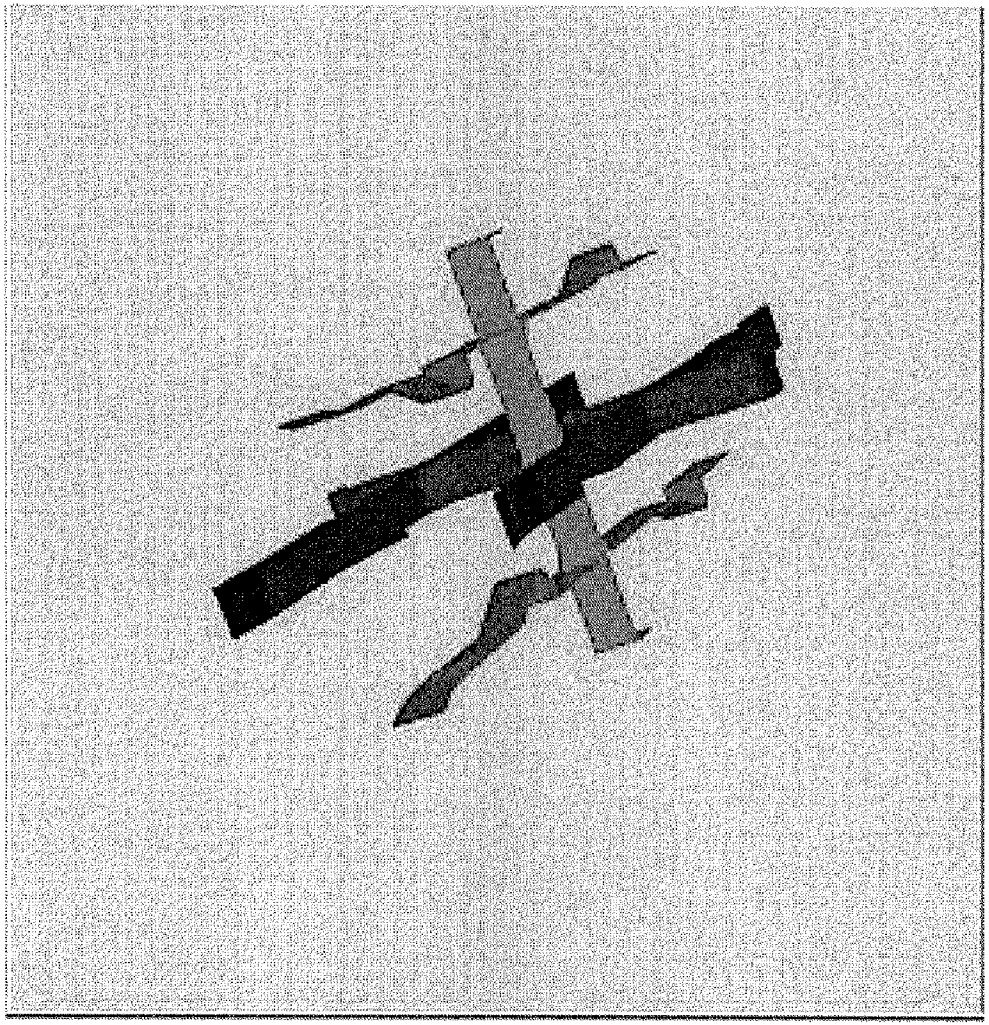
FIG. 13 shows an alternate embodiment using stamped metal sub-parts.

FIG. 13 shows an alternate embodiment using stamped metal sub-parts. The cell would consist of stamped metal parts. The parts are braze welded together to make a cell. The cells are polarized to attach to other cells.

Figure 14:
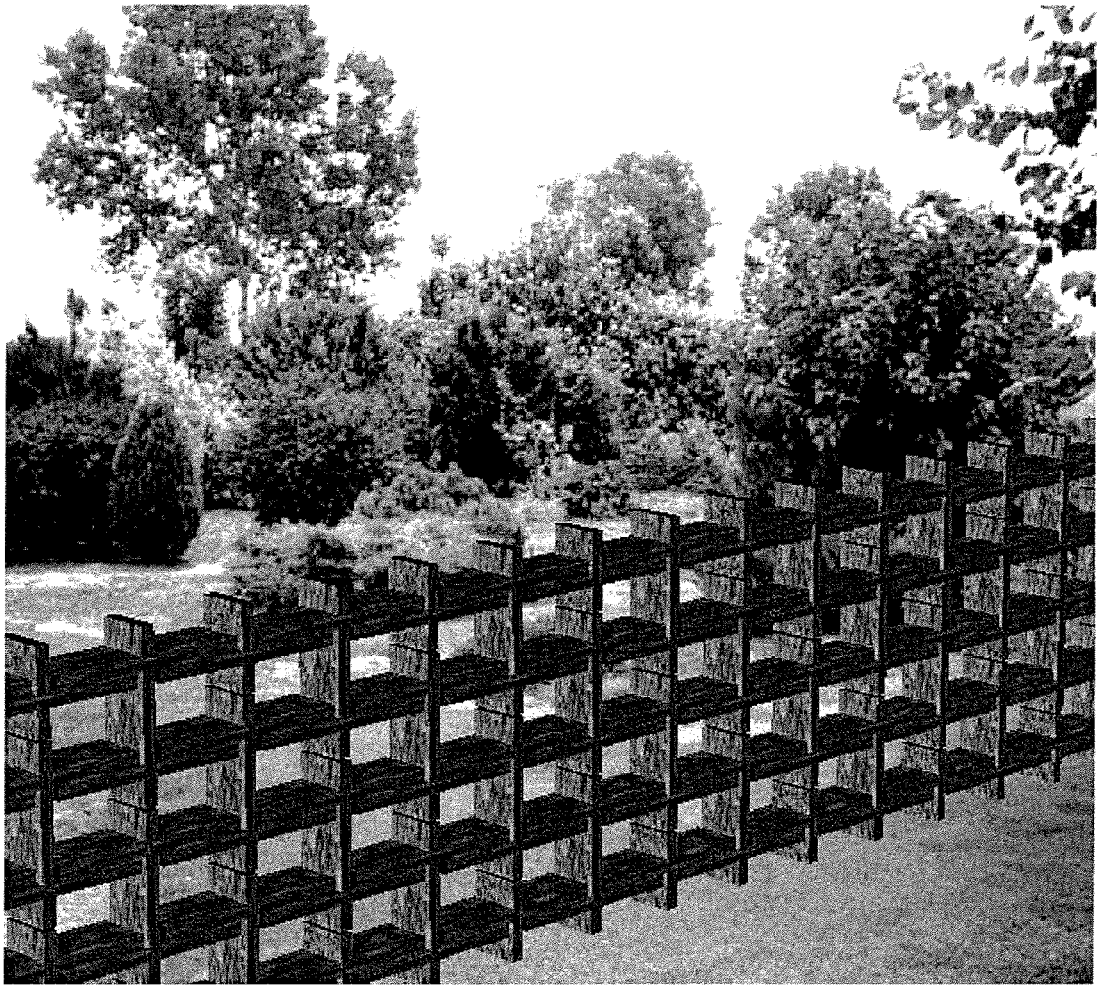
FIG. 14 is a two dimensional exemplary embodiment showing a fence made up of cells manufactured from stone.

FIG. 14 is a two dimensional exemplary embodiment showing a fence made up of cells manufactured from stone.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A cellular building block comprising:

a middle beam;

a first leg coupled to the middle beam such that the leg is perpendicular to the middle beam, the first leg having an inside edge with at least one protrusion and at least one recess located along the inside edge; and a second leg coupled to the middle beam such that the leg is perpendicular to the middle beam and spaced apart from the first leg, the second leg having an inside edge with at least one protrusion and at least one recess located along the inside edge;

wherein the distance between the inner edges of the first and second legs is within a threshold amount of one half the length of the middle beam; and wherein the at least one protrusion located along the inside edge of the first leg is configured to fit into the at least one recess located along the inside edge of the second leg and the at least one protrusion located along the inside edge of the second leg is configured to fit into the at least one recess located along the inside edge of the first leg.

2. The cellular building block of claim 1 wherein the first leg and the second leg have a guide at a first end and at a second end.

3. The cellular building block of claim 2 wherein the guide is configured to urge another cellular block into a connection.

4. The cellular building block of claim 1 wherein the at least two legs are equally spaced from a first end and a second end of the middle beam.

5. The cellular building block of claim 1 wherein the depth of each protrusion is less than half of the width of a leg.

6. The cellular building block of claim 1 wherein the cellular building block is constructed out of ceramic materials.

7. The cellular building block of claim 1 wherein the cellular building block is constructed out of metal materials.

8. The cellular building block of claim 1 wherein the cellular building block is constructed out of concrete materials.

9. The cellular building block of claim 1 wherein the cellular building block is constructed out of clay materials.

10. The cellular building block of claim 1 wherein the cellular building block is constructed out of plastic materials.

11. The cellular building block of claim 1 wherein the cellular building block is constructed out of stone materials.

12. The cellular building block of claim 1 wherein the dimensions of the protrusions located on the first and second legs are proportionally related to the dimensions of the legs.

13. A method for connecting cellular building blocks comprising:

aligning a guide portion on a first leg of a first block with a guide portions on a second leg of a second block and aligning a guide portion on a second leg of the first block with a guide portion on a first leg of a third block, wherein each block comprising a middle beam, a first leg coupled to the middle beam having at least one protrusion and at least one recess located along an inside edge of the first leg, a second leg coupled to the middle beam, spaced apart from the first leg and having at least one protrusion and at least one recess located along an inside edge of the second leg, and wherein the at least one protrusion located along the inside edge of the first leg is configured to fit into the at least one recess located along the inside edge of the second leg and the at least one protrusion located along the inside edge of the second leg is configured to fit into the at least one recess located along the inside edge of the first leg;

applying pressure sufficient to urge together the at least one protrusion located along the inside edge of the first leg of the first block and the at least one recess located along the inside edge of the second leg of the second block or the at least one recess located along the inside edge of the first leg of the first block and the at least one protrusion along the inside edge of the second leg of the second block; and applying pressure sufficient to urge together the at least one protrusion located along the inside edge of the second leg of the first block and the at least one recess located along the inside edge of the first leg of the third block or the at least one recess located along the inside edge of the second leg of the first block and the at least one protrusion along the inside edge of the first leg of the third block.

14. The method of claim 13 wherein the distance between the inner edges of the first and second legs is within a threshold amount of one half the length of the middle beam.

15. The method of claim 13 wherein the dimensions of the protrusions located on the first and second legs are proportionally related to the dimensions of the legs.

* * * * *

UNITED STATES PATENT AND TRADEMARK OFFICE

CERTIFICATE OF CORRECTION

PATENT NO. : 7,975,452 B2
APPLICATION NO. : 11/933949
DATED : July 12, 2011
INVENTOR(S) : Paul Wennberg It is certified that error appears in the above-identified patent and that said Letters Patent is hereby corrected as shown below:

Title Page, "(75)" is corrected to read -- (76) --

Title Page, Below Item (75) delete

"(73) Assignee: B. Braun Medizinelektronik GmbH & Co. KG, Puchheim (DE)"

Signed and Sealed this
Sixth Day of May, 2014

Michelle K. Lee

Michelle K. Lee
*Deputy Director of the United States Patent and Trademark Office*